US006474910B2

(12) United States Patent
Lay

(10) Patent No.: US 6,474,910 B2
(45) Date of Patent: Nov. 5, 2002

(54) ROCKBOLT ASSEMBLY

(75) Inventor: Warren Thomas Lay, Catawba, VA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/833,279

(22) Filed: Apr. 12, 2001

(65) Prior Publication Data

US 2001/0046418 A1 Nov. 29, 2001

Related U.S. Application Data

(60) Provisional application No. 60/198,648, filed on Apr. 20, 2000.

(51) Int. Cl.[7] ..... E21D 21/00

(52) U.S. Cl. ..... 405/259.4; 405/259.1; 405/259.5; 405/302.1; 411/383; 411/395; 411/82

(58) Field of Search ..... 405/259.1, 259.4, 405/259.5, 302.1, 302.3; 411/82, 82.1, 930, 395, 383, 384

(56) References Cited

U.S. PATENT DOCUMENTS 3,302,410 A * 2/1967 McLean ..... 405/259.5 X
4,636,115 A * 1/1987 Davis et al. ..... 405/259.4
4,655,644 A 4/1987 Lane et al. ..... 405/260
4,984,937 A * 1/1991 Karpellus ..... 405/259.1 X
5,556,233 A * 9/1996 Kovago ..... 405/259.4
5,636,945 A 6/1997 Oddbjorn Nes ..... 405/259.1
5,827,014 A * 10/1998 Swemmer ..... 405/302.3 X

OTHER PUBLICATIONS

Williams Form Engineering Corp. web page entitled "Rock Anchor Systems", 6 printed pages, located at http://www.williamform.com/spinlock,html, Apr. 4, 2001.

* cited by examiner

*Primary Examiner*—Heather Shackelford
*Assistant Examiner*—Sunil Singh
(74) *Attorney, Agent, or Firm*—Michael Best & Friedrich LLP

(57) ABSTRACT

A rockbolt assembly for securement within a borehole generally comprising a rockbolt, an anchor, a hollow tube assembly, a faceplate and a nut. The rockbolt has a threaded free end and a second end associated with the anchor. The hollow tube assembly has open first and second ends and an internally extending threaded portion configured to engage the rockbolt. The threaded portion is positioned between the ends with respective first and second tube areas defined on opposite sides thereof. At least one channel is defined in the tube assembly and extends from one tube area to the other such that a continuous passage traversing the threaded portion is defined between the ends of the tube assembly. The nut engages the tube assembly and the faceplate such that tightening of the nut about the tube assembly is translated through the rockbolt to cause engagement of the anchor.

17 Claims, 3 Drawing Sheets

ROCKBOLT ASSEMBLY

This application claims the benefit of U.S. Provisional Application No. 60/198,648 filed on Apr. 20, 2000.

BACKGROUND

The present invention relates to rockbolts and more particularly to an assembly for securing a rockbolt within a borehole.

Rockbolts are long bolts, typically between 8 to 12 feet, used to support surfaces, for example, the roof of an underground excavation. The inner end is secured in a borehole in the surface and the outer end engages a faceplate which engages the surface. There are generally two types of rockbolts: untensioned rockbolts which engage the borehole along substantially the length of the bolt supporting the surface by engaging the overlying rock, and tensioned rockbolts which engage the rock at the inner end and at the outer end compress the surrounding rock. In the grid-like pattern in which the bolts are used, tensioned rockbolts create ribs of compressed rock across the surface which act like beams.

Referring to FIG. 1, a prior art tensioned rockbolt assembly 10 is illustrated. The assembly 10 includes a faceplate 12 positioned about the borehole 14 and a rockbolt 16 extending through the plate 12 into the borehole 14. The inner end of the rockbolt 16 engages and actuates an anchor 18 positioned in the borehole 14. While the anchor 18 is illustrated as an expansion nut and bail, other anchors can be utilized, for example, expanded wedges or curable resins. To tension the rockbolt 10, a nut 20 on the outer end of the rockbolt 16 is tightened against a grout bulb 22 configured to seat against the faceplate 12. A good description of prior rockbolts and anchors can be found in Underground Excavations in Rock by E. Hoek and E. T. Brown.

When rockbolts 10 are permanently installed, it is generally desirable to backfill the borehole 14 with grout after the rockbolt 16 is tensioned to protect the rockbolt 16 and anchor 18 from corrosion. To facilitate such, many prior art rockbolts 10 include a tube 24 extending from the grout bulb 22 toward the inner end of the rockbolt 16. A side opening 26 is provided in the grout bulb 22 for injection of pressurized grout (not shown). A grout sealer 30 is provided adjacent the juncture between the grout bulb 22 and nut 20 to reduce the potential for leaking at the juncture and to ensure the grout flows through the tube 24 toward the inner end of the borehole 14. After filling the inner end, the grout flows back along the outside of the tube 24 to fill the remainder of the borehole 14. A check port 28 is often provided in the faceplate 12 to ensure complete fill of the borehole 14.

SUMMARY

The present invention provides an improved rockbolt assembly. The assembly generally comprises a rockbolt, an anchor, a hollow tube assembly, a faceplate and a nut. The rockbolt has a threaded free end and a second end associated with the anchor. The hollow tube assembly has open first and second ends and an internally extending threaded portion, configured to engage the rockbolt free end, which is positioned between the ends. A passage, including at least one channel traversing the threaded portion, extends between the ends of the tube assembly. The tube assembly allows installation of a standard rockbolt and also the direct injection of back-fill grout through an easily accessible open tube which does not require internal sealers. The faceplate has an aperture therethrough adapted to be positioned about the borehole and to receive the tube assembly. The nut directly engages the faceplate and the tube assembly such that tightening of the nut about the tube assembly is translated through the rockbolt to cause engagement of the anchor.

DETAILED DESCRIPTION OF THE PREFERRED EMBODIMENTS

Figure 1:
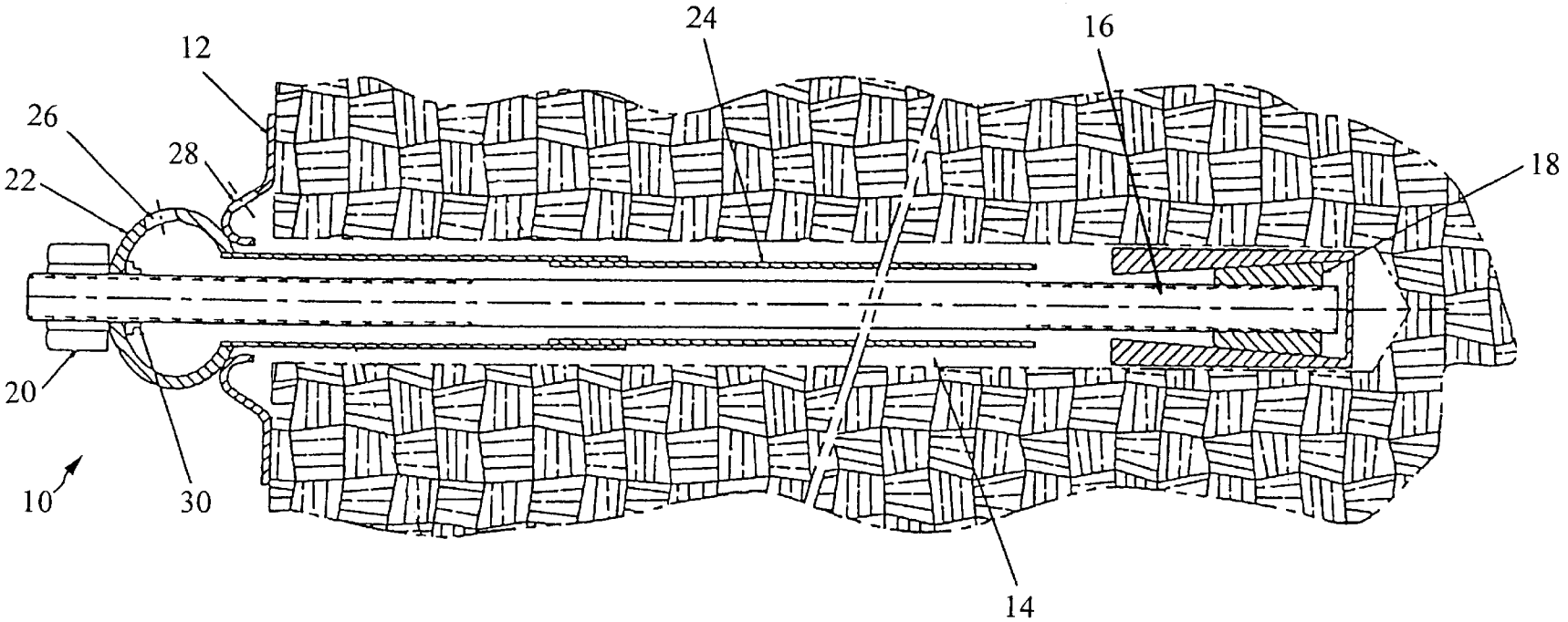
Fig. 1 (Prior Art)
FIG. 1 is a cross-sectional view of a prior art rockbolt assembly positioned within a borehole.

The preferred embodiments of the present invention will be described with reference to the drawing figures wherein like numerals represent like elements throughout. Elements in common with the prior art assembly 10 of FIG. 1 also have the same reference numerals. Certain terminology, for example, "inner", "inward", "outer", "outward", "front", "frontward", "forward", "back", "rear" and "rearward", is used in the following description for relative descriptive clarity only and is not intended to be limiting.

Figure 2:
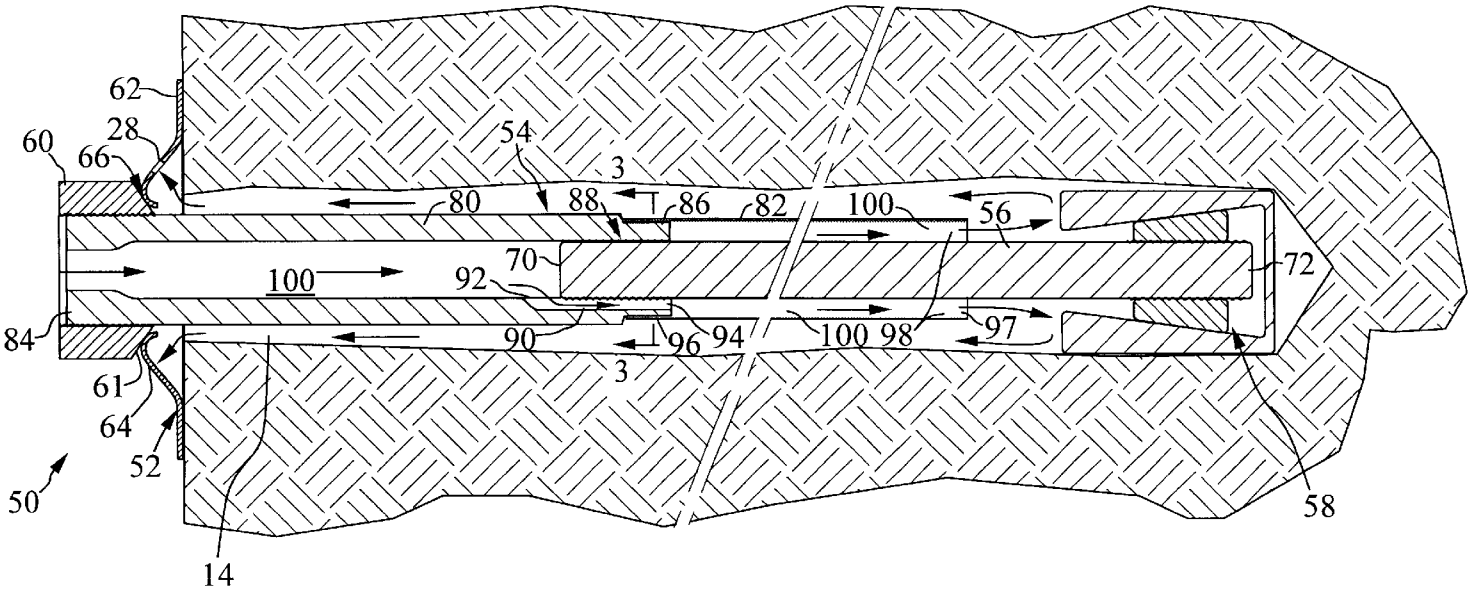
FIG. 2 is a cross-sectional view of a first embodiment of the rockbolt assembly of the present invention positioned within a borehole.
Figure 3:
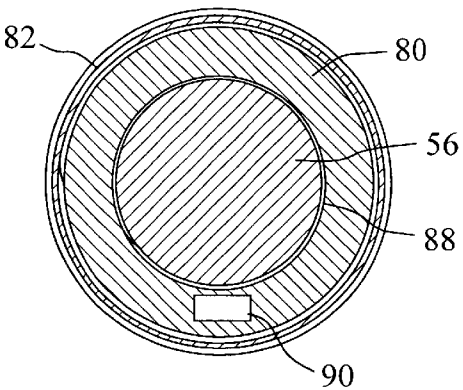
FIG. 3 is a cross-sectional view along the line 3—3 in FIG. 2.

Referring to FIGS. 2 and 3, a rockbolt assembly 50 that is a first embodiment of the present invention is shown. The rockbolt assembly 50 generally comprises a faceplate 52, a tube assembly 54, a rockbolt 56, an anchor 58, and a nut 60. The faceplate 52 has a rock engaging surface 62 and a raised area 64 with a tube receiving aperture 66 therethrough. The size and configuration of the engaging surface 62, raised area 64 and aperture 66 can be varied as desired. A check port 28 is preferably provided as a visual check to ensure complete filling of the borehole 14 as will be described hereinafter. The rockbolt 56 has an outer, threaded end 70 and an inner end 72 configured to engage the anchor 58. As described above, while the anchor 58 is shown as an expansion nut and bail, other anchors can be utilized.

Tube assembly 54 is comprised of two hollow tubes 80 and 82. The first hollow tube 80 has an outer open end 84 with external threads configured to engage the nut 60, as will be described hereinafter. The inner end 86 of the tube 80 has an area of internal threads 88 configured to mate with the threaded end 70 of the rockbolt 56. The rockbolt 50 can be secured within the borehole 14 using only the first tube 80. The rockbolt 56, anchor 58 and tube 80 are positioned in the borehole 14 with the tube 80 passing through the aperture 66 in the faceplate 52. The nut 60 is threadably mated with the externally threaded end 84 of tube 80. The nut 60 preferably has a tapered radial inner surface 61 configured to directly engage the raised portion 64 of the faceplate 52. As the nut 60 is tightened about the tube 80, it compresses against the raised portion 64 and tensions the tube 80, which in turn tensions the rockbolt 56, thereby causing engagement of the anchor 58. The tube 80 is preferably manufactured from cast iron, but can be manufactured from other materials, for example, metals or synthetics, which provide sufficient strength to support the tension translated to the rockbolt 56. The tube 80 is manufactured as an independent component and interconnected to the rockbolt 56 at a junction having sufficient strength to translate the tenstion through the tube 80 to the rockbolt 56. This allows the assembly 50 of the present invention to utilize a standard rockbolt 56, in contradistinction with some other assemblies which require a specialized rockbolt, for example, a substantially hollowed out rockbolt. Besides the increased cost of hollowed out rockbolts, the rockbolts also tend to be weaker do to the hollowing.

As explained above, it is often desirable to back-fill the borehole 14 with grout to protect the rockbolt 56 and anchor 58 from corrosion. To facilitate passage of grout through the tube 80 and past the connected rockbolt 56, a channel 90 is formed in the wall of tube 80 adjacent the inner end 86 such that the channel 90 traverses the area of internal threads 88. That is, the channel 90 has an opening 92 into the hollow portion of the tube 80 and an opening 94 out the inner end 86 of the tube 80. As such, even with the tube 80 and rockbolt 56 connected, a continuous passage exists from the open outer end 84 of the tube 80 out the inner end 86. A single channel 90 is illustrated, however, more than one channel may be utilized as desired. Alternatively, or in addition thereto, the channel 90 can also be formed in the rockbolt 56 itself over a relatively small distance. That is, the channel 90 can be formed from the end 70 of the rockbolt 56 inward to an exit port just past the threads of the rockbolt 56. The channel 90 thereby bypasses the threaded area to allow the continuous passage, but without the cost or reduced strength of a substantially hollowed rockbolt.

While the grout can be injected through tube 80 only, it is preferable to also include the second hollow tube 82 to deliver the grout further inward into the borehole 14 to ensure a more complete fill. The second hollow tube 82 has an outer end 96 configured to sealingly engage the external surface of the first tube 80 about its inner end 86. The tube 82 also has an inner end 97. Various methods of engagement, for example, a threaded connection, thermal adhesion, or chemical adhesion, may be utilized to join the tubes 80, 82. As can be seen in FIG. 2, inner end 86 of tube 80 may have a reduced external diameter such that tube 82 is flush with or slightly recessed from the remainder of tube 80. The internal diameter of tube 82 is greater than the diameter of the rockbolt 56 such that an internal annular space 98 is defined about the rockbolt 56 over the length of the tube 82. As such, a continuous grout passage 100 extends from the open outer end 84 of tube 80, through the channel 90, and out the inner end 97 of tube 82. Tube 82 is preferably manufactured from plastic or the like as it is not subject to a significant load.

To back-fill the borehole 14, grout is injected through open end 84 of tube 80. Since the opening in end 84 is on the end surface of the rockbolt assembly 50, as opposed to the prior art side opening 26 which may be located at any angular position about the borehole 14, it is generally easier for the grout operator to locate the opening. Additionally, since the open end 84 provides a direct opening into the passage 100 and there are no other junctures, a grout sealer is not required. This is preferred as many prior art sealers 30 interfere with the threads of the prior art rockbolt 16 causing operational difficulty or undesirable stresses on the rockbolt 16. The injected grout travels through the channel 90 into the internal annular space 98 of tube 82. The grout exits the open end 97 of tube 82 where it is delivered adjacent the inner end of the rockbolt 56 and the anchor 58. After filling the inner end, the grout fills backward or outward around the outside of the tube assembly 54 to completely fill the borehole 14. The check port 28 provides a visual indicator of the return flow of grout.

Figure 4:
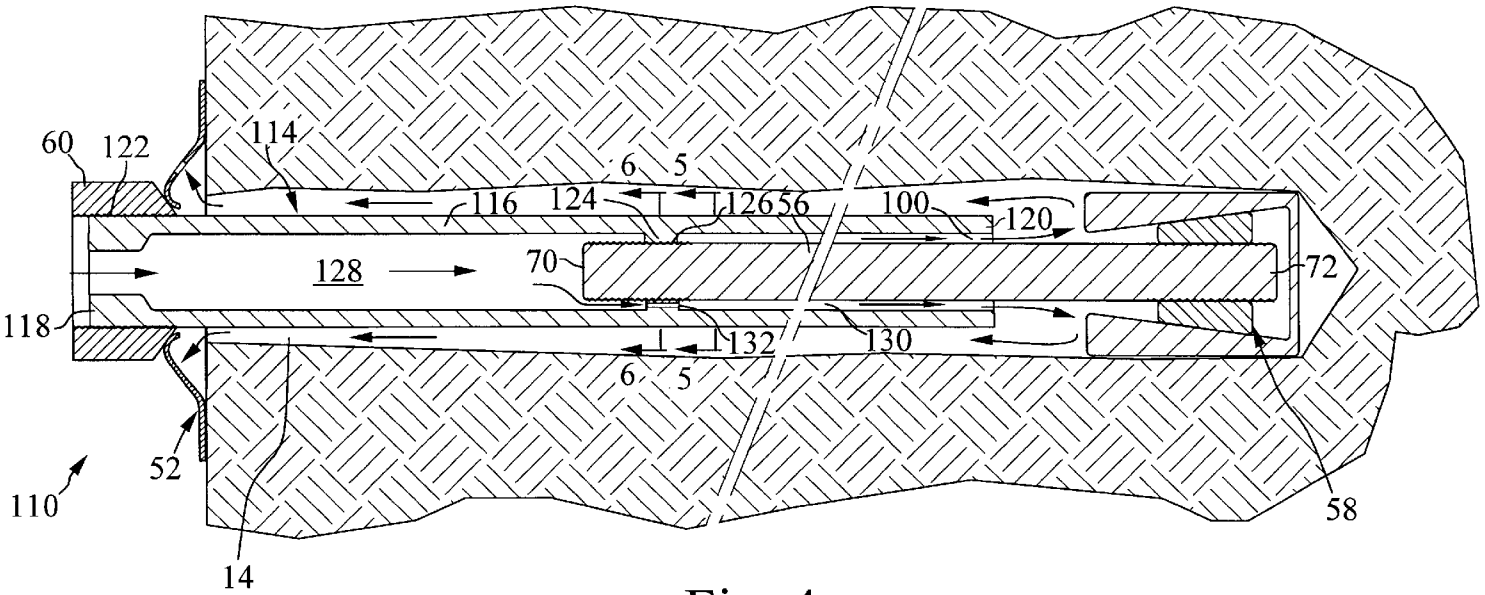
FIG. 4 is a cross-sectional view of a second embodiment of the rockbolt assembly of the present invention positioned within a borehole.
Figure 6:
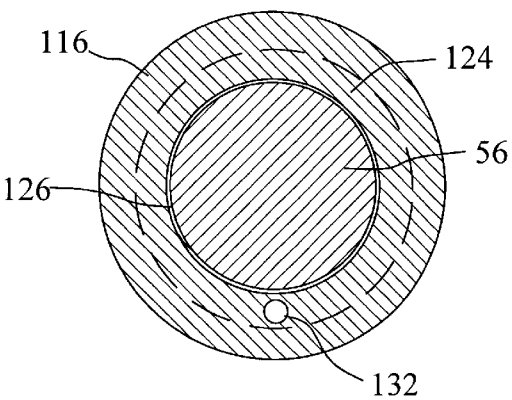
FIG. 6 is a cross-sectional view along the line 6—6 in FIG. 4.
Figure 5:
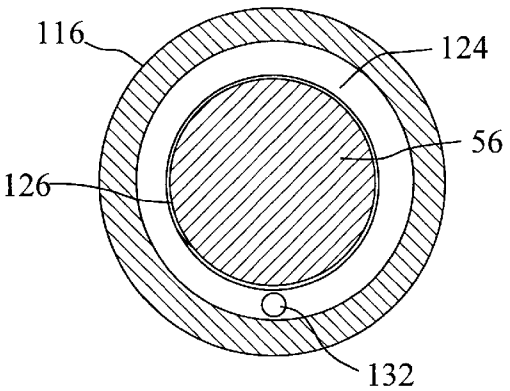
FIG. 5 is a cross-sectional view along the line 5—5 in FIG. 4.

Referring to FIGS. 4–6, a rockbolt assembly 110 that is a second embodiment of the present invention is shown. The rockbolt assembly 110 is similar in all respects to the first embodiment except for the tube assembly 114. Tube assembly 114 comprises a single hollow tube 116 having outer and inner open ends 118, 120. The outer end 118 has external threads 122 configured to mate with the threads of nut 60. The tube 116 has a radially, inwardly extending threaded shoulder 124 extending into the hollow tube 116 between the ends 118, 120, thereby defining spaced chambers 128 and 130. The shoulder 124 is preferably proximate the outer end 118, but can be positioned anywhere between the ends 118, 120. The threads 126 of shoulder 124 are configured to mate with the threaded end 70 of the rockbolt 56. At least one channel 132 extends through the shoulder 124 to connect the chambers 128, 130 such that a continuous passage is defined between the open ends 118 and 120. The rockbolt assembly 110 is utilized in a manner similar to that described above with respect to the first embodiment.

What is claimed is:

1. A device for securing a rockbolt within a borehole, the rockbolt having a threaded free end and a second end associated with an anchor, the device comprising:

a tube assembly having open first and second ends, an internal threaded portion adapted to engage the rockbolt free end, and an internal passage, including at least one channel traversing the threaded portion, extending between the ends of the tube assembly to define a continuous material passage from the first end out the second end; the tube assembly including first and second tubes sealingly interconnected with the first tube having an end with an external circumferential recess configured to be received in the second tube; and a nut configured to engage the first end of the tube assembly such that actuation of the nut relative to the tube assembly tensions the rockbolt which causes engagement of the anchor.

2. The device of claim 1 wherein the first tube is manufactured from metal and the second tube is manufactured from plastic.

3. The device of claim 1 wherein the first and second tubes are threadably interconnected.

4. The device of claim 1 further comprising a surface plate having an aperture therethrough adapted to be positioned about the borehole and to receive the tube assembly.

5. The device of claim 4 wherein the nut directly engages the surface plate.

6. The device of claim 4 wherein the surface plate has a raised portion and the nut has a tapered radial surface configured to directly engage the raised portion.

7. The device of claim 1 wherein the threaded portion is defined along an internal surface of an internally extending shelf.

8. The device of claim 7 wherein the internally extending shelf is positioned proximate the first end of the tube assembly.

9. A device for securing a rockbolt within a borehole, the rockbolt having a threaded free end and a second end associated with an anchor, the device comprising:

a tube assembly having open first and second ends, an internal threaded portion adapted to engage the rockbolt free end, and an internal passage, including at least one channel traversing the threaded portion, extending between the ends of the tube assembly to define a continuous material passage from the first end out the second end; the tube assembly including first and second tubes that are sealingly and adhesively interconnected; and a nut configured to engage the first end of the tube assembly such that actuation of the nut relative to the tube assembly tensions the rockbolt which causes engagement of the anchor.

10. A device for securing a rockbolt within a borehole, the rockbolt having a threaded free end and a second end associated with an anchor, the device comprising:

a first tube having open first and second ends, an internal threaded portion adapted to engage the rockbolt free end, and an internal first passage, including at least one channel traversing the threaded portion, extending between the first and second ends;

a second tube positionable about the rockbolt and having open third and fourth ends with an internal second passage extending therebetween;

the first tube second end sealingly engaging the second tube third end with the first and second passages aligned such that a continuous material passage is defined from the first tube first end out the second tube fourth end; and a nut configured to engage the first tube first end such that actuation of the nut relative to the first tube tensions the rockbolt which causes engagement of the anchor.

11. The device of claim 10 wherein the first tube is manufactured from metal and the second tube is manufactured from plastic.

12. The device of claim 10 wherein the first and second tubes are threadably interconnected.

13. The device of claim 10 wherein the first and second tubes are adhesively interconnected.

14. The device of claim 10 wherein the first tube second end has an external circumferential recess configured to be received in the second tube.

15. The device of claim 10 further comprising a surface plate having an aperture therethrough adapted to be positioned about the borehole and to receive the first tube.

16. The device of claim 15 wherein the nut directly engages the surface plate.

17. The device of claim 15 wherein the surface plate has a raised portion and the nut has a tapered radial surface configured to directly engage the raised portion.

* * * * *